US007800024B2

(12) United States Patent
Duguay et al.

(10) Patent No.: US 7,800,024 B2
(45) Date of Patent: Sep. 21, 2010

(54) LITHIC WIRELESS WARMING TABLE AND PORTABLE HEATERS

(76) Inventors: Michel A. Duguay, 825 Beauregard, Apt. 914, Sainte-Foy, Québec (CA) G1V 4L7; Philippe Faucher, 3206 50$^{th}$ Avenue, Grand-Mère, Québec (CA) G9T 1A3

( * ) Notice: Subject to any disclaimer, the term of this patent is extended or adjusted under 35 U.S.C. 154(b) by 1304 days.

(21) Appl. No.: 11/235,897

(22) Filed: Sep. 27, 2005

(65) Prior Publication Data

US 2006/0076006 A1 Apr. 13, 2006

Related U.S. Application Data

(60) Provisional application No. 60/612,791, filed on Sep. 27, 2004.

(51) Int. Cl.
*H05B 3/68* (2006.01)
*H05B 3/50* (2006.01)

(52) U.S. Cl. ..... 219/460.1; 219/544

(58) Field of Classification Search ... 219/443.1–468.2, 219/544–553

See application file for complete search history.

(56) References Cited

U.S. PATENT DOCUMENTS 2,879,369 A * 3/1959 Huseby ..... 392/430
3,602,693 A * 8/1971 Grounner ..... 219/553
3,961,157 A 6/1976 Miller et al.
4,134,643 A 1/1979 Lee
4,303,448 A 12/1981 Palmour, III et al.
4,379,832 A * 4/1983 Dalal et al. ..... 438/582
4,507,083 A 3/1985 Fraioli
4,634,373 A 1/1987 Rattner
4,702,693 A 10/1987 Fraioli
4,889,103 A 12/1989 Fraioli
4,900,581 A * 2/1990 Stuke et al. ..... 427/555
5,036,179 A 7/1991 Westerberg et al.
5,154,160 A 10/1992 Burtea et al.
5,381,729 A 1/1995 Hennessy et al.
5,400,765 A 3/1995 Goldstein et al.
5,472,721 A 12/1995 Eisenberg et al.
5,885,636 A 3/1999 Carville
5,898,180 A 4/1999 Venkataramani
5,905,269 A 5/1999 Venkataramani et al.
5,942,142 A 8/1999 Forney et al.
6,069,345 A 5/2000 Westerberg
6,125,234 A 9/2000 de Jenlis
6,297,481 B1 10/2001 Gordon
6,414,283 B1 7/2002 McNamara

* cited by examiner

*Primary Examiner*—Sang Y Paik
(74) *Attorney, Agent, or Firm*—Fay Kaplun & Marcin, LLP

(57) ABSTRACT

A method and system for supplying thermal energy to a selected area, in which thermal energy is stored in a sensible heat storage. Thermal energy from the sensible heat storage is optically guided, and eventually also thermally conducted through a thermal energy propagation path from the sensible heat storage to the selected area. A flux of thermal energy is controlled through the propagation path from the sensible heat storage to the selected area to control the amount of thermal energy supplied to the selected area.

5 Claims, 14 Drawing Sheets

"Coffeepot" type guided infrared heater for an individual plate or coffee cup on the dinner table Fig. 1 Stone table top heated in selected places by infrared radiation from the lithic storage transmitted by thermally insulated waveguides.
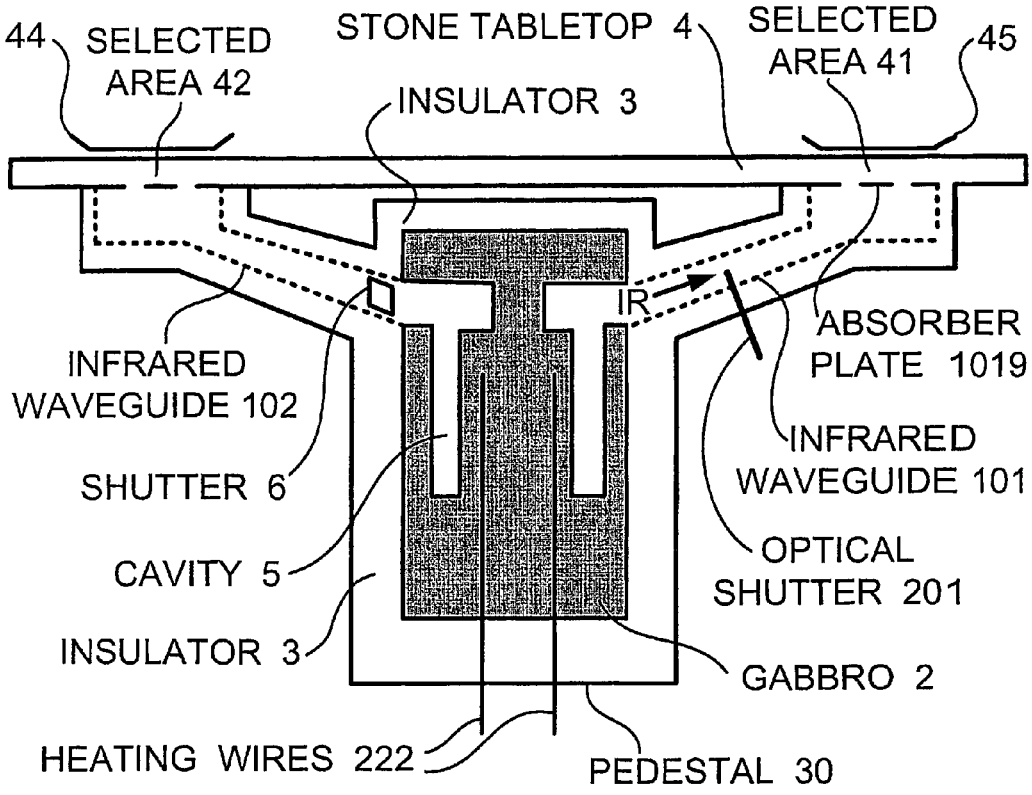

Fig. 2 Wooden tabletop with metal plates heated by infrared radiation guided in from the lithic storage.
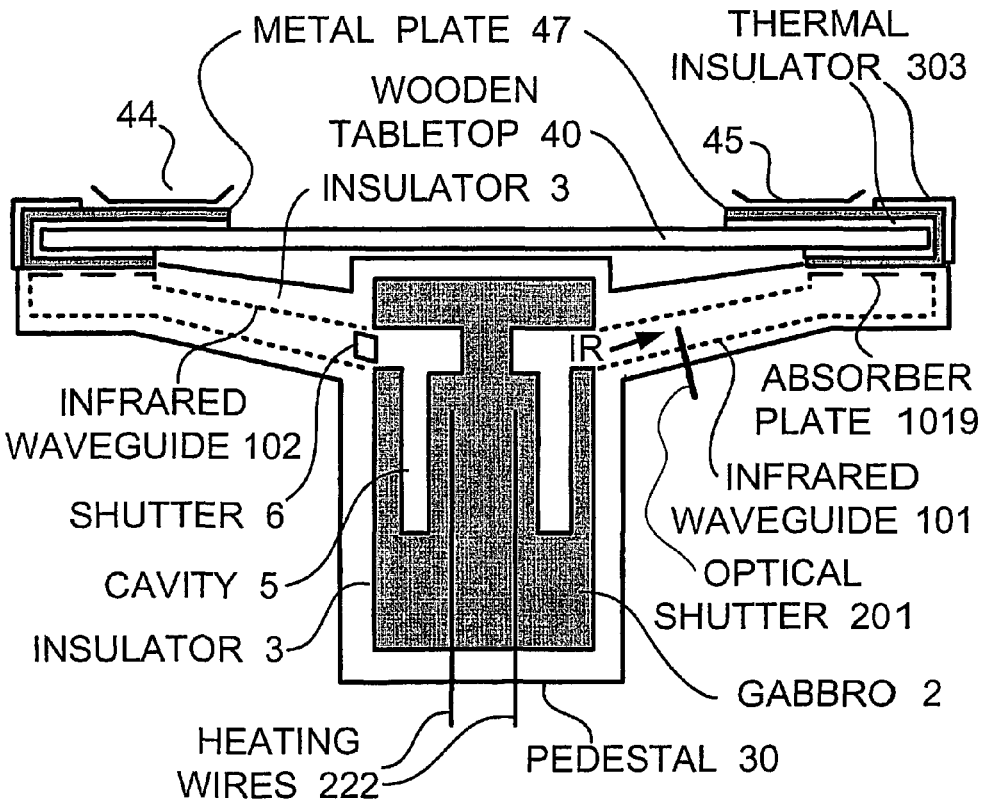

Fig. 3 Cross sectional side view of "soup kettle" type thermal storage with waveguide and metal plate for cooking and warming food on the dinner table.
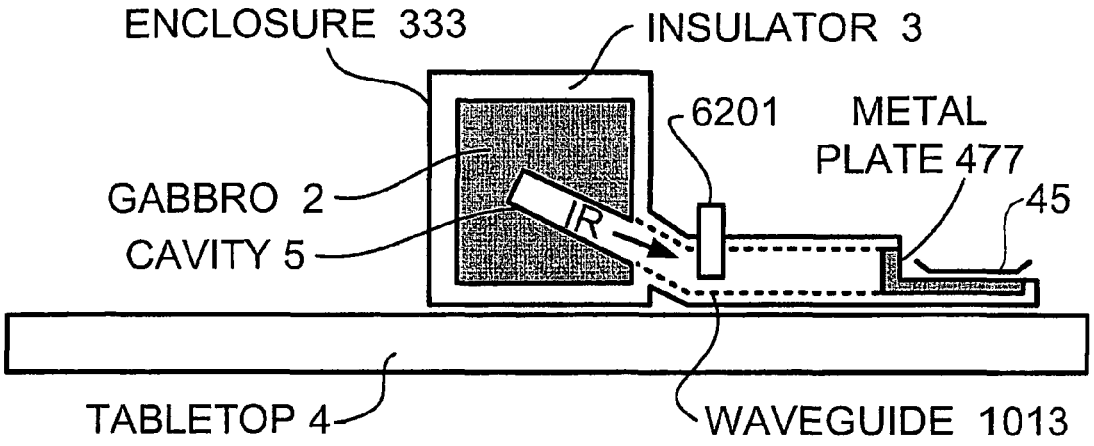

Fig. 4 Transport of infrared radiation from an alumina-based thermal storage to the tabletop by means of optical guides made up of curved mirrors.
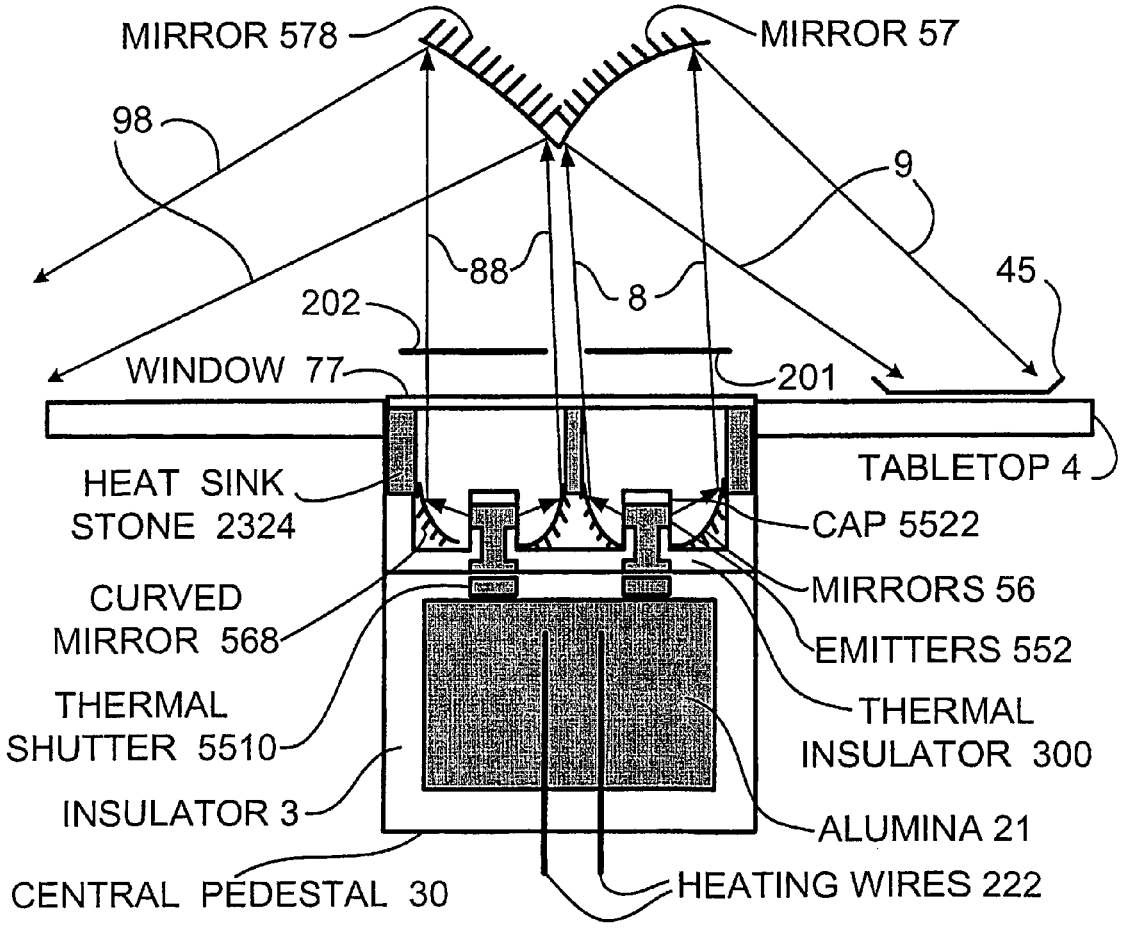

Fig. 5 a) Horizontal cross sectional view of thermal shutter used to control the flow of heat into the infrared emitters of Fig. 4.
b) Vertical sectional view of the thermal shutter shown in Fig. 4.
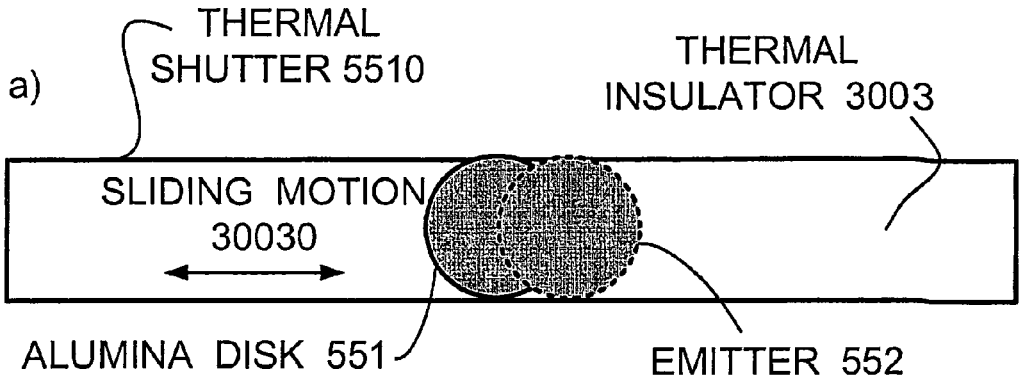
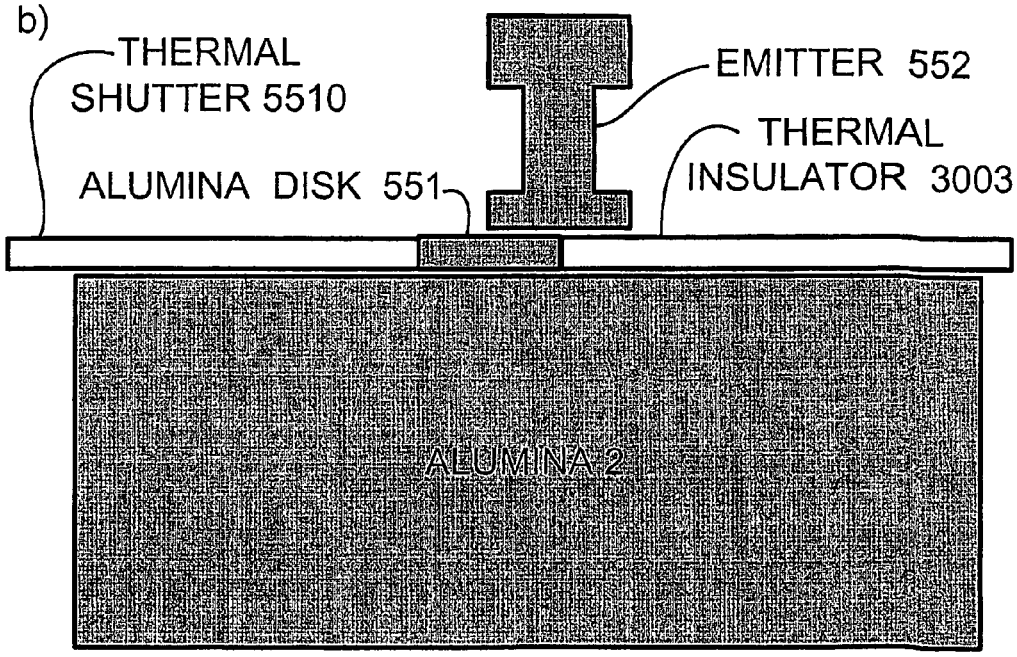

Fig. 6 "Soup kettle" alumina-based thermal storage couples electromagnetic radiation into curved mirror optical guides.
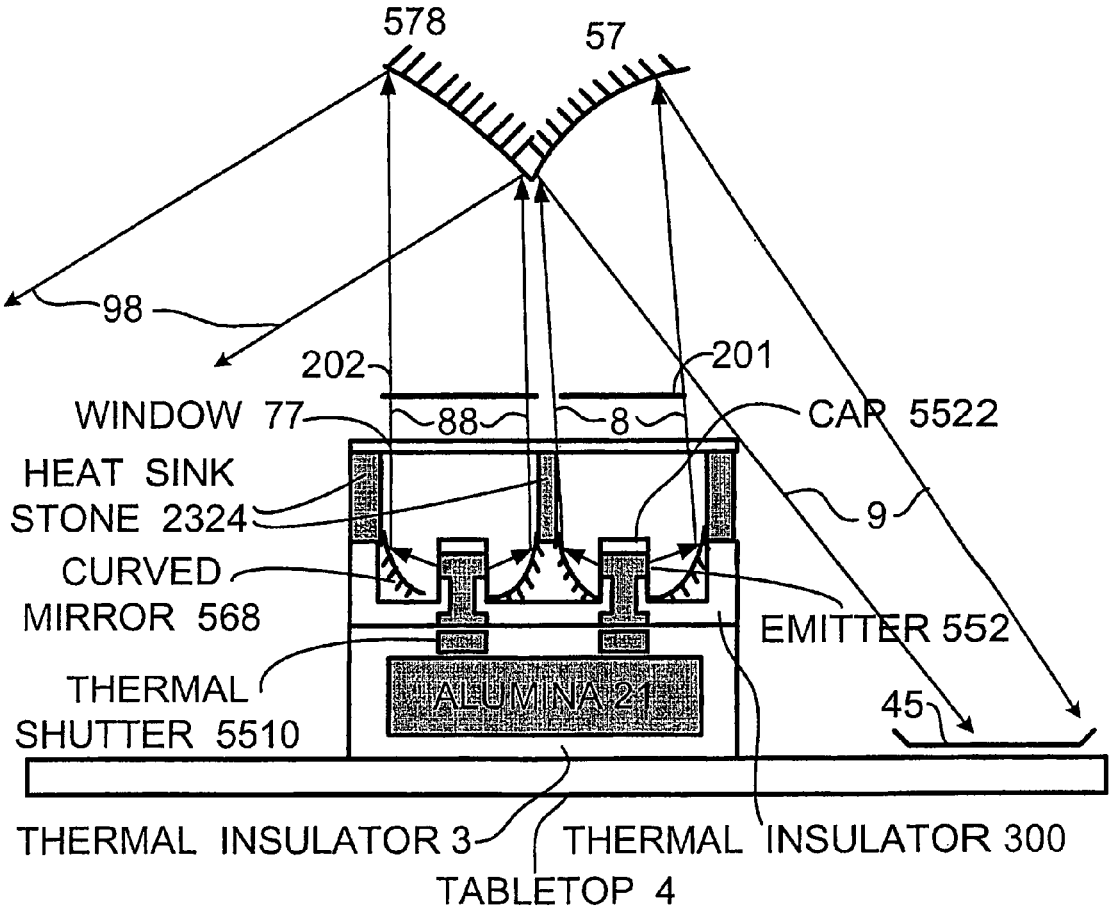

Fig. 7 Mobile "coffeepot" type guided infrared heater using curved mirror optical waveguide.
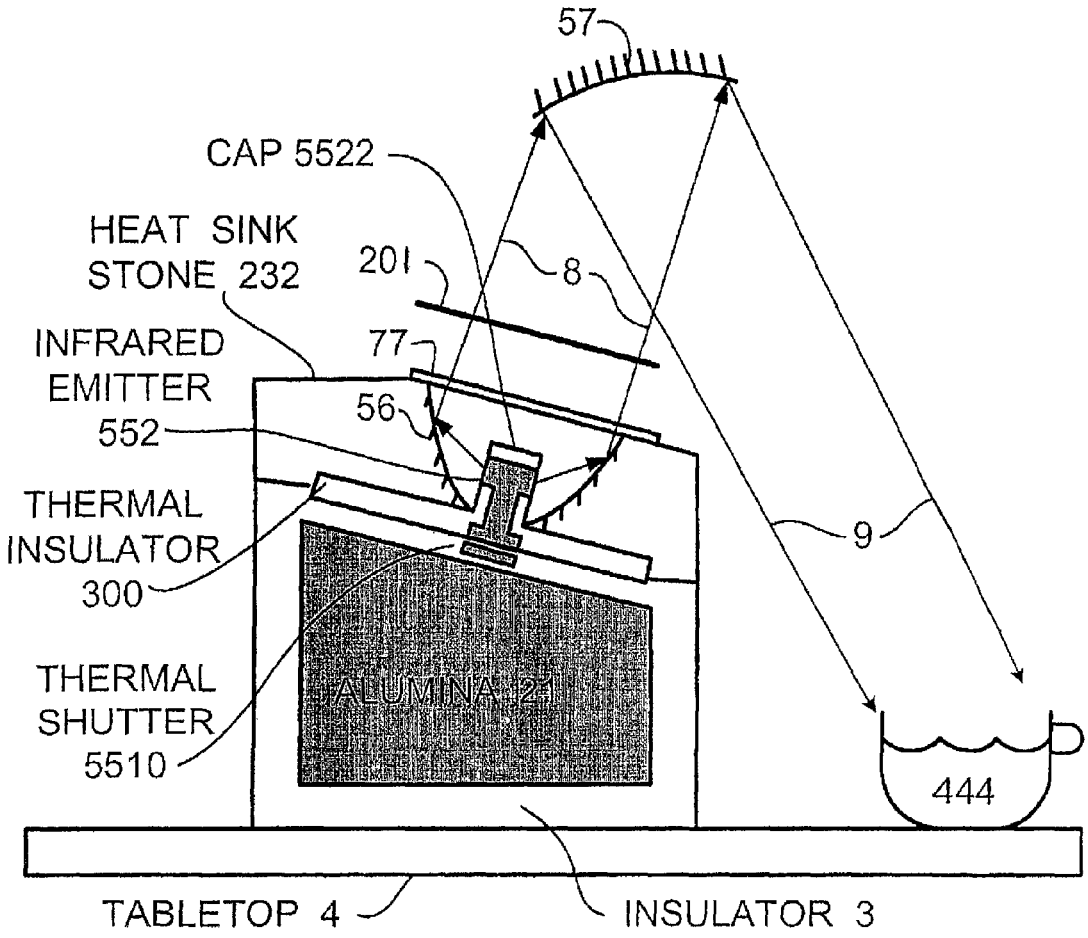

Fig. 8 "Coffeepot" type guided infrared heater for an individual plate or coffee cup on the dinner table
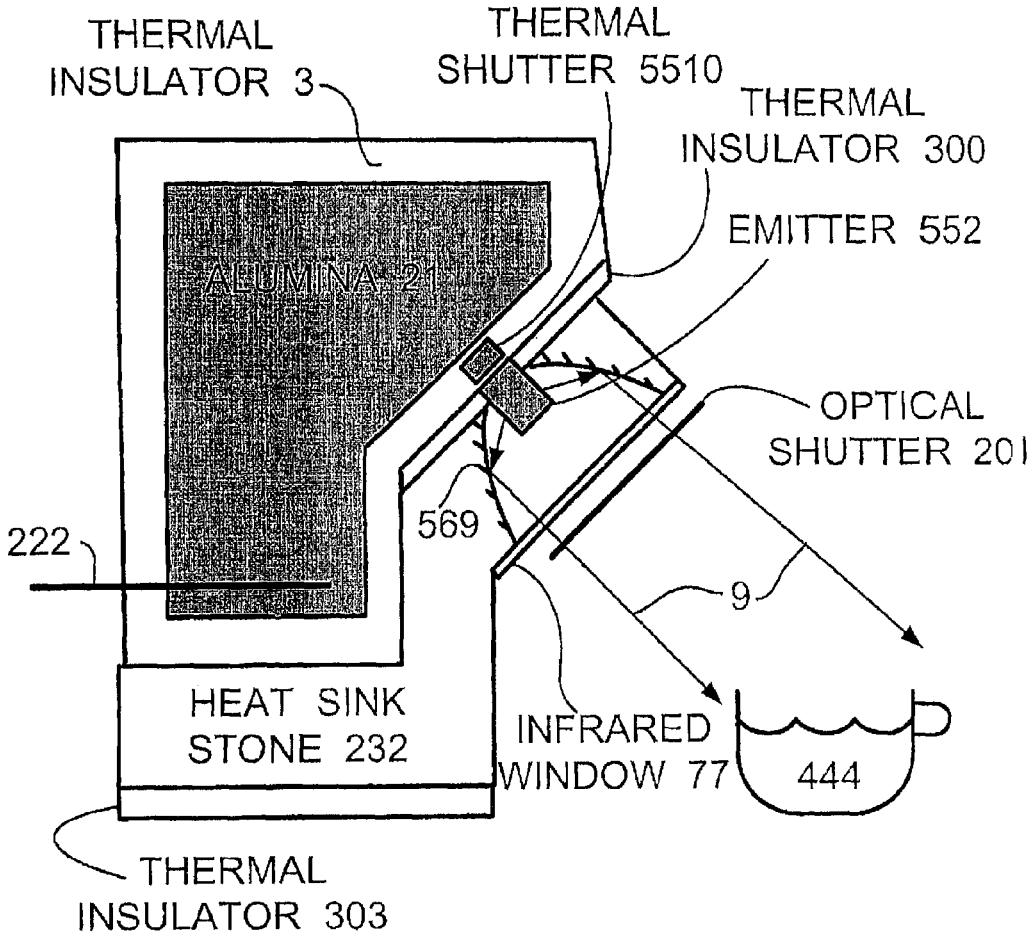

Fig. 9 Mobile "coffeepot" type guided infrared heater with waveguide transport of thermal energy to radiant emitter.
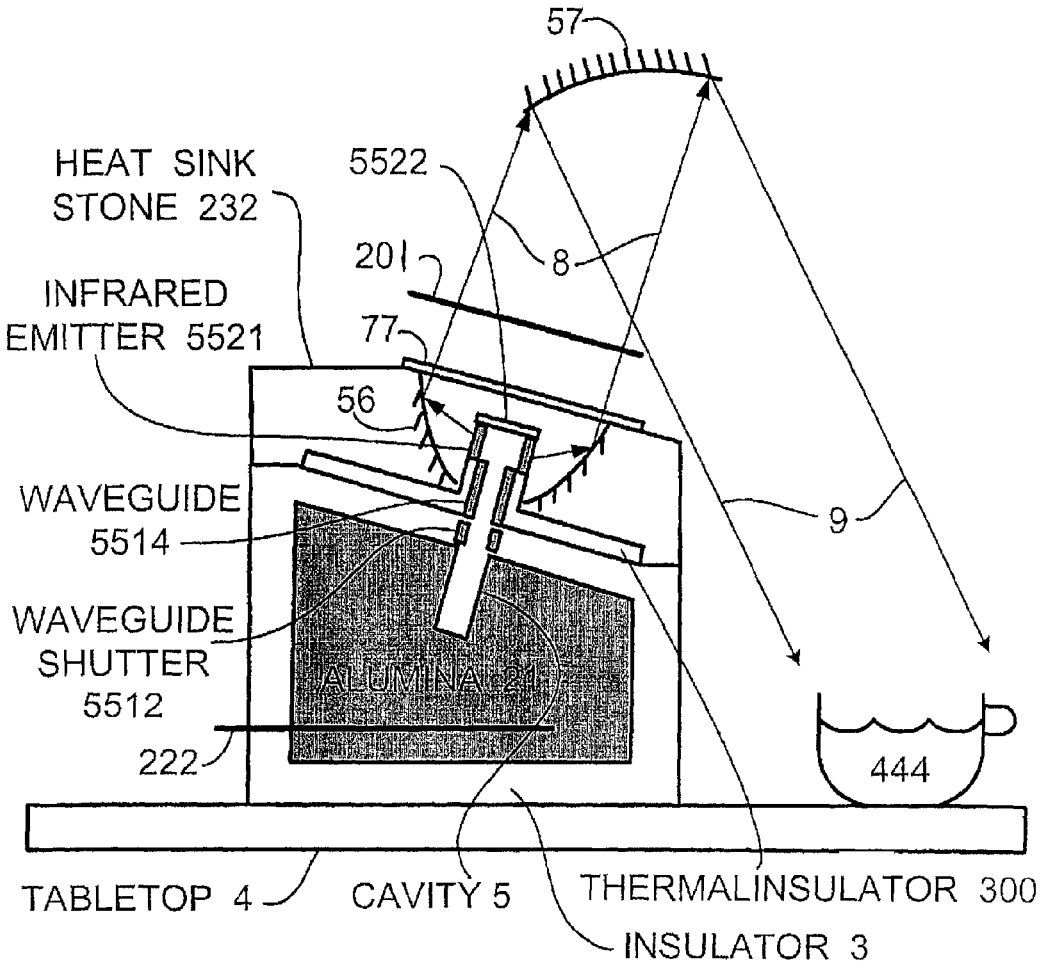

Fig. 10 Side cross sectional view of "soup kettle" type thermal storage with waveguide resonator in vertical position for keeping people warm at the table.
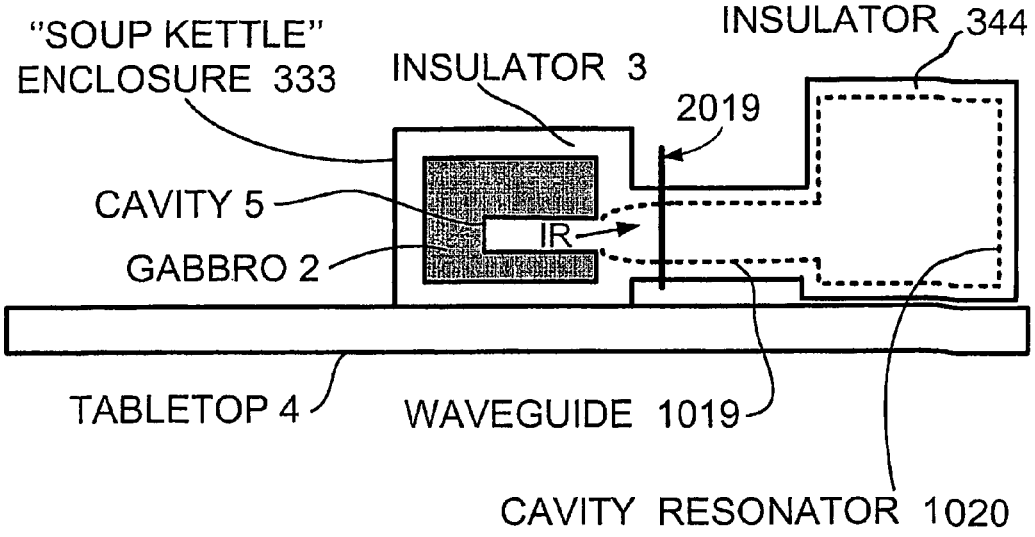

Fig. 11 Arrangement of resonator radiant heaters for keeping people warm at the dinner table
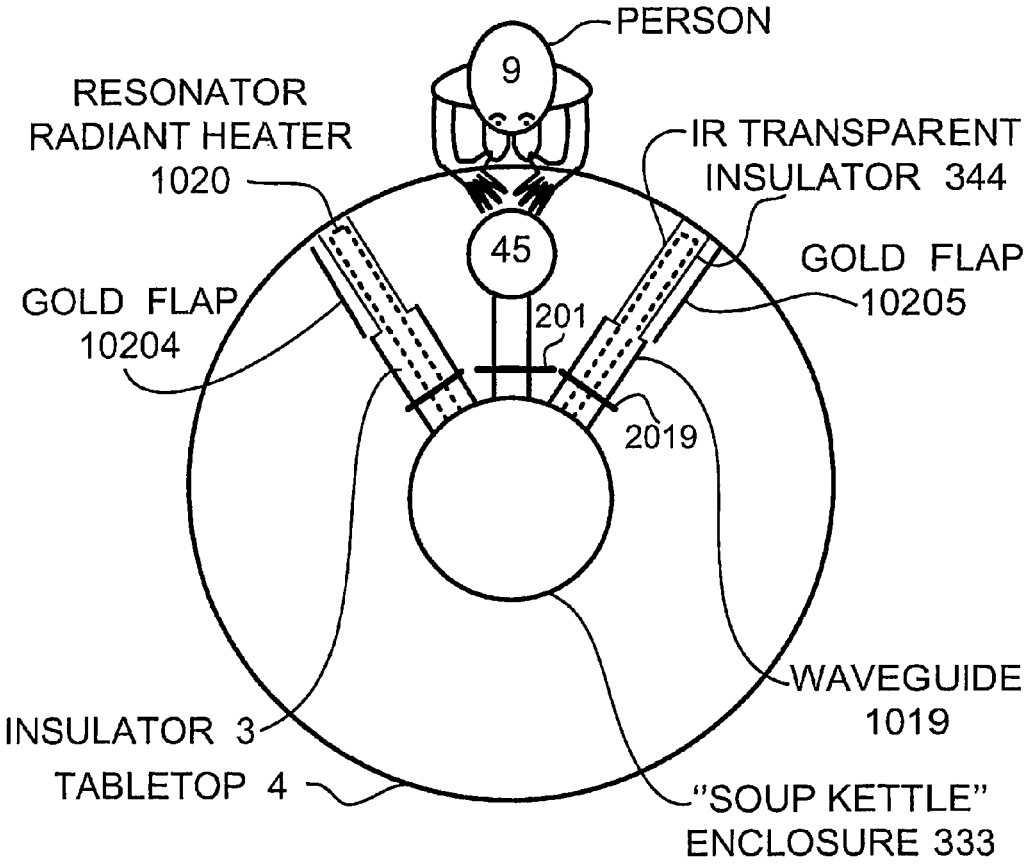

Fig. 12 a) Cross sectional view of arrangement for keeping food and people warm at a wooden dinner table;
b) side view of metal plate radiant heater and connecting metal plate thermal conductor
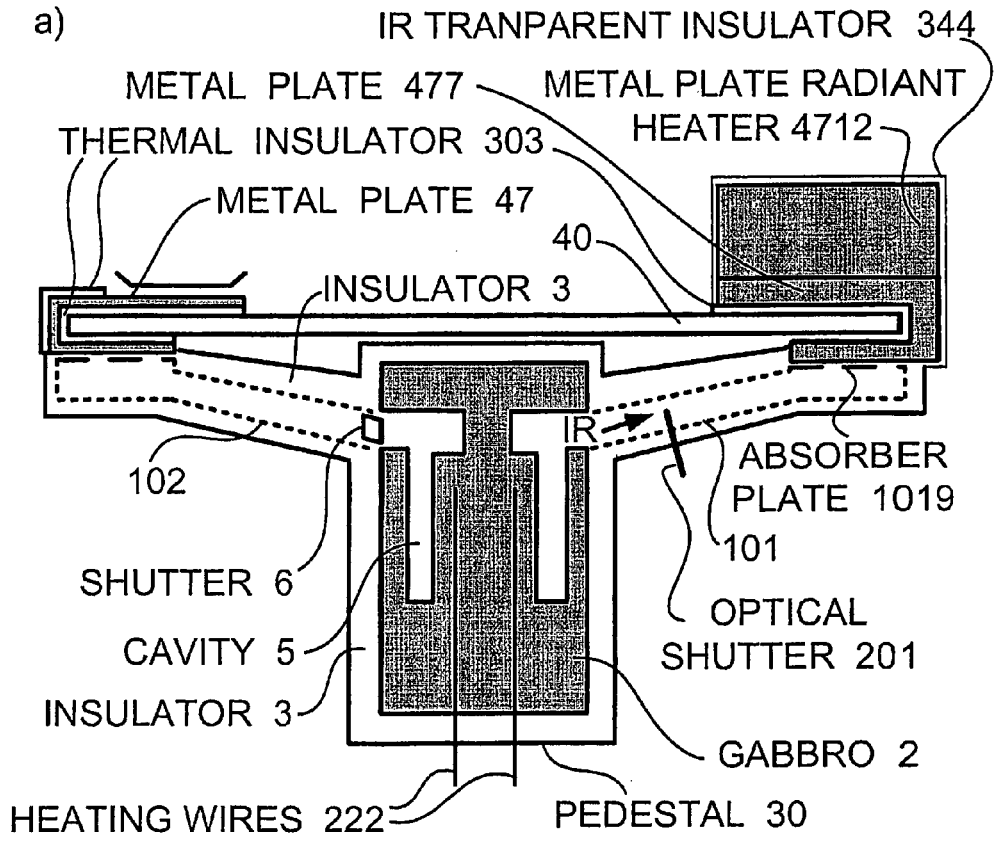
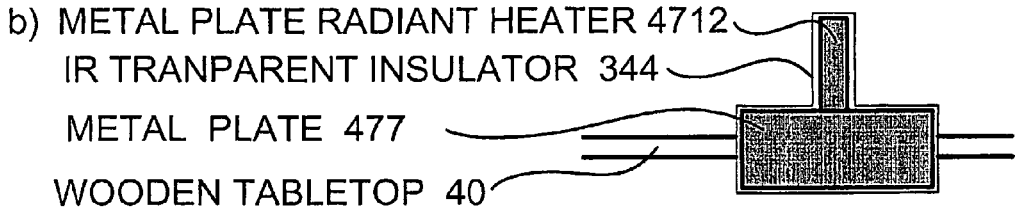

Fig. 13 Mobile wireless radiant heater with waveguide transport of thermal energy to infrared emitter.
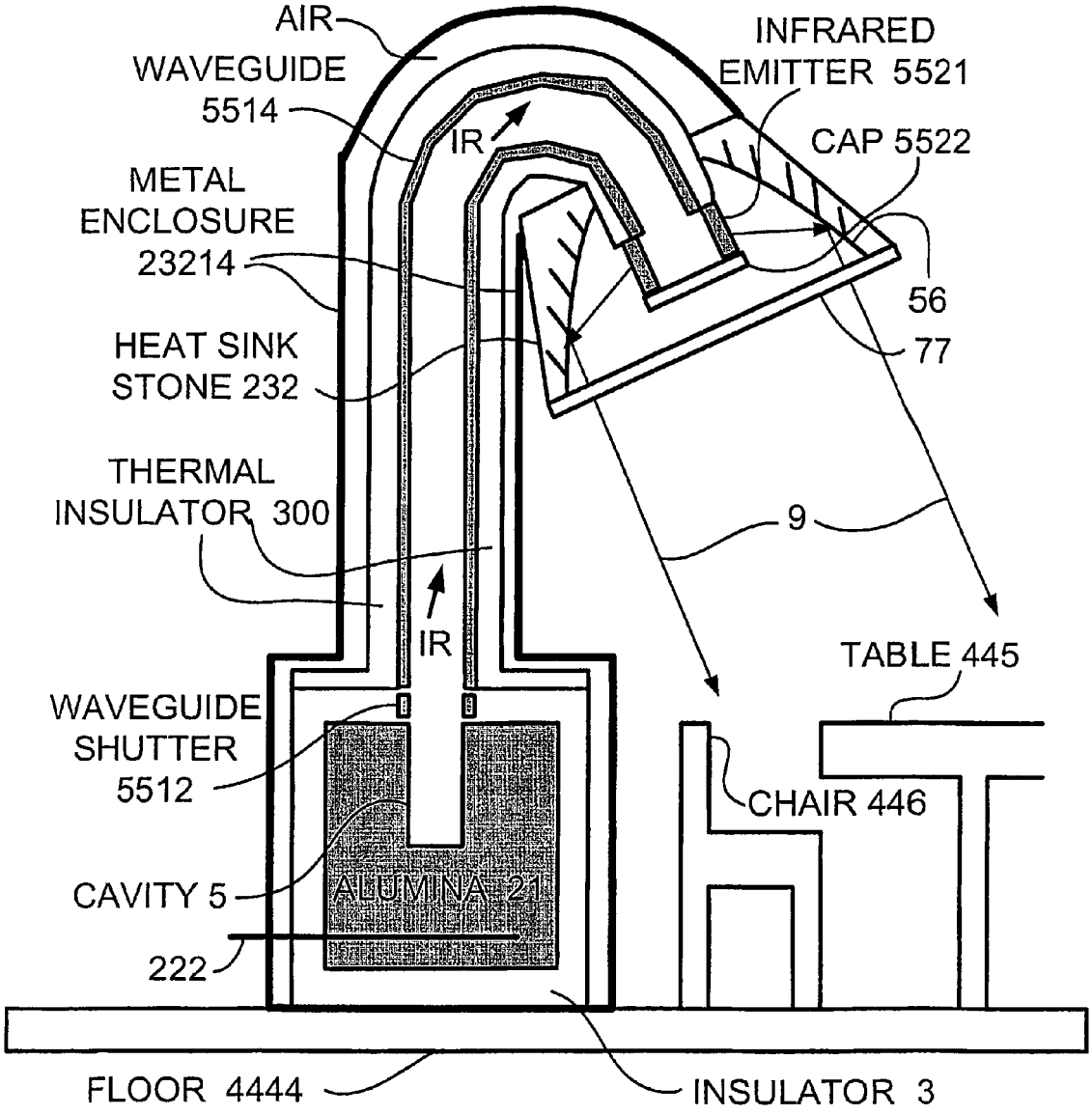

Fig. 14 a) Radiant heater with waveguide transport of thermal energy to infrared emitter in a cylindrical reflector geometry.
b) waveguide radiant heater fed from one end by guided infrared.
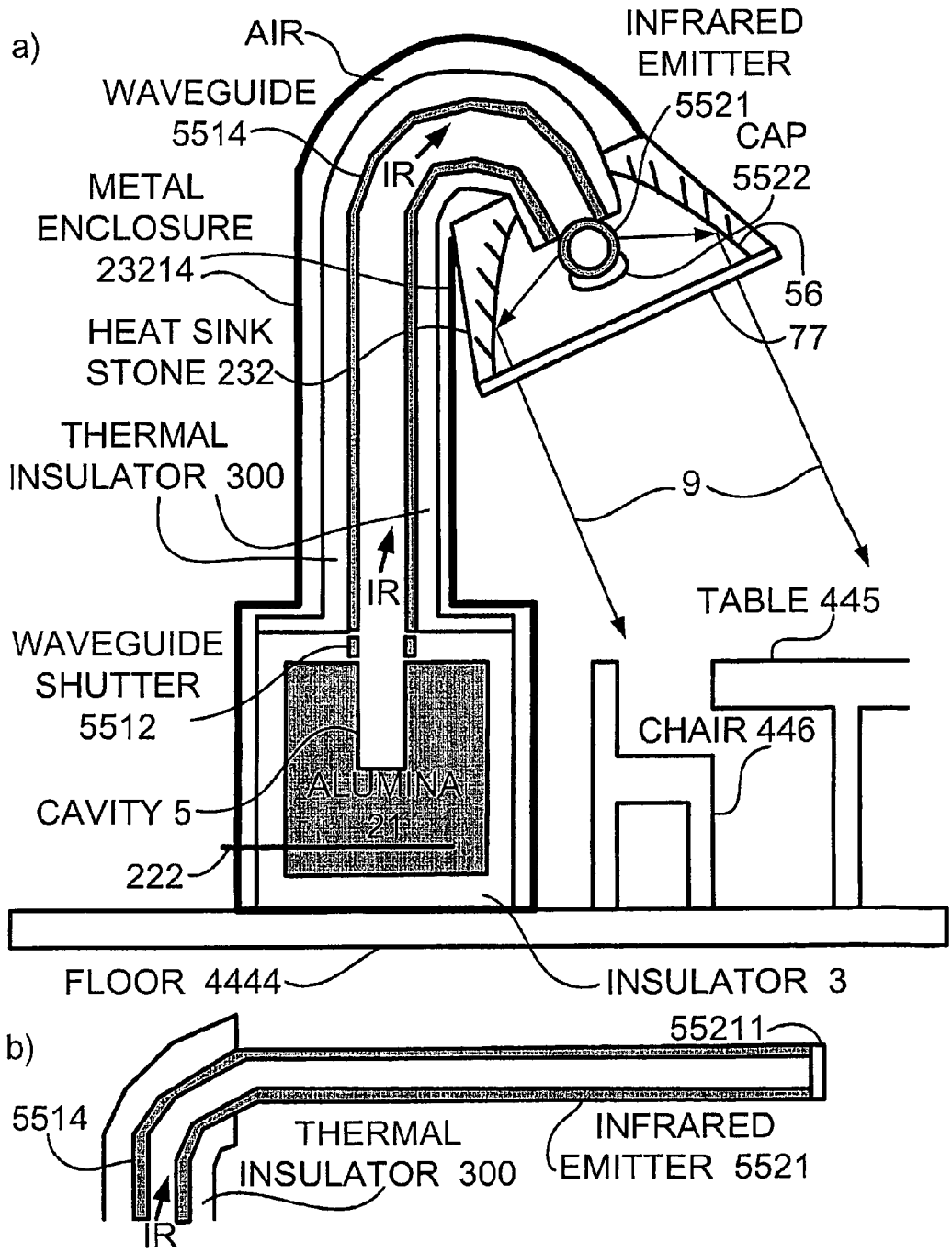

LITHIC WIRELESS WARMING TABLE AND PORTABLE HEATERS

PRIORITY CLAIM

This application claims priority to U.S. Provisional Patent Application No. 60/612,791 filed on Sep. 27, 2004 and entitled "Lithic Wireless Warming Table and Portable Heaters," the entire specification of which is expressly incorporated herein, in its entirety, by reference.

FIELD OF THE INVENTION

The present invention relates to a method and system for providing controllable thermal energy to a selected area. More specifically, but not exclusively, heat is stored in a lithic high temperature thermal storage, optical means are used to guide the thermal radiation to the selected area and adjustable shutters can be used to control the flux of thermal radiation delivered to the selected area. As a non-limitative example, the invention will be useful in wireless and fireless cooking at a dinner table and for keeping food and people warm in various places.

BACKGROUND OF THE INVENTION

The need for keeping food warm at the table throughout dinner has long been felt. In recent decades the need for cooking at the table has also been added. Running electric wires to the table and using electric heaters is one way to meet the need for heat at the table. However, such a practice is cumbersome and presents the danger that people could trip over the wires and cause a painful accident. Electric wires could in principle be avoided by using batteries placed on or underneath the table. The problem with batteries is that they are expensive, have a limited lifetime and present the danger of exploding when accidentally shorted.

Traditionally another way to keep food warm or to cook on a dining table has been to use fires fed by some liquid or solid chemical. These present the well-known danger of accidentally burning people, sometimes seriously. In addition they burden the atmosphere with pollutants.

An ancient technique for cooking or keeping food warm has been to use a thermal storage system, often in the form of hot stones. The coupling of thermal energy has been done through simple proximity conductive or convective thermal coupling. The disadvantage of these systems is that one has no control over the temperature at which thermal energy is delivered and almost no control over its temporal and spatial distribution.

SUMMARY OF THE INVENTION

To overcome the above drawbacks, the present invention provides a system for supplying thermal energy to a selected area, comprising: a sensible heat storage to generate thermal radiation; optically guiding means defining a thermal radiation propagation path from the sensible heat storage to the selected area; and an adjustable control of a flux of thermal radiation through the propagation path from the sensible heat storage to the selected area to control the amount of thermal energy supplied to the selected area.

The present invention also relates to a system for supplying thermal energy to a selected area, comprising: a sensible heat storage sub-system to generate thermal radiation; a thermal energy transport sub-system comprising thermally conducting means and optically guiding means defining a thermal energy propagation path from the sensible heat storage sub-system to the selected area; and an adjustable control of a flux of thermal energy through the propagation path from the sensible heat storage sub-system to the selected area to control the amount of thermal energy supplied to the selected area.

In accordance with the present invention there is further provided a system for supplying thermal energy to at least one selected area of a tabletop, comprising: a sensible heat storage sub-system disposed under the tabletop to generate thermal radiation; a thermal radiation wave guiding sub-system defining a thermal radiation propagation path from the sensible heat storage sub-system underneath the tabletop to the at least one selected area of the tabletop; and an adjustable control of a flux of thermal energy through the propagation path from the sensible heat storage sub-system to the at least one selected area of the tabletop to control the amount of thermal energy supplied to said at least one selected area of the tabletop.

The present invention still further relates to a system for supplying thermal energy to a selected area, comprising: a sensible heat storage sub-system to generate thermal radiation; a thermal radiation wave guiding sub-system comprising a series of optically guiding means defining a thermal radiation propagation path from the sensible heat storage sub-system to the selected area, this series of optically guiding means comprising a thermally insulated first hollow core waveguide to propagate and couple thermal radiation into a second hollow core waveguide serving as a radiator near the selected area, the second waveguide forming part of a waveguide resonator having at least one infrared-transparent surface portion through which infrared light is radiated to warm up people or food in the selected area; and an adjustable control of a flux of thermal energy through the propagation path from the sensible heat storage sub-system to the selected area to control the amount of thermal energy supplied to the selected area.

According to the invention, there is also provided a method for supplying thermal energy to a selected area, comprising: storing thermal energy in a sensible heat storage; generating thermal radiation from the sensible heat storage; optically guiding the thermal radiation through a thermal radiation propagation path from the sensible heat storage to the selected area; and controlling a flux of thermal radiation through the propagation path from the sensible heat storage to the selected area to control the amount of thermal energy supplied to the selected area.

The present invention further relates to a method for supplying thermal energy to a selected area, comprising: storing thermal energy in a sensible heat storage; generating thermal radiation from the sensible heat storage; thermally conducting and optically guiding thermal energy through a thermal energy propagation path from the sensible heat storage to the selected area; and controlling a flux of thermal energy through the propagation path from the sensible heat storage sub-system to the selected area to control the amount of thermal energy supplied to the selected area.

According to a non-limitative example, sensible heat is stored at high temperature in refractory materials in a structure which facilitates the emission of thermal radiation and/or the coupling of this thermal radiation to optical waveguides in a controllable fashion so that the radiation delivers heat on demand to selected area(s) for example at a dinner table for the purpose of cooking and keeping food and people warm.

The thermal storage medium may be formed by certain types of stones or stone-derived refractory materials (hence the word "lithic") kept within a thermally insulated enclosure at temperatures typically in the range 400 to 1100° C. At these temperatures the volume energy storage density in the form of sensible heat is comparable to or exceeds the stored electric energy density of lithium-ion batteries. Gabbro stone will be taken as a non-limitative example of material that can work at temperatures up to approximately 900° C. In cooling from 900 to 400° C. one liter of gabbro releases about 1.2 MJ of energy, or 0.33 kWh/L, which is approximately the electric energy storage density of a lithium-ion battery. Another material that will taken as a non-limitative example is alumina, which can be used at temperatures up to at least 1400° C.

A cylindrical hole can be drilled in a block of solid material to radiate approximately blackbody radiation through the circular opening of this hole. In the temperature range of 400-1100° C. infrared (IR) power densities in the range 1-20 Watts/cm$^2$ can be expected in the idealized model of the lithic emitter taken as a blackbody, this radiation being emitted into a $2\pi$ solid angle. This primary blackbody emission can be coupled into a thermally insulated optical waveguide for delivery to a target. A metallic pipe or duct with a very smooth inner surface can serve as an optical waveguide. A gold coating can be provided on the inside surface of the metal to improve its reflectivity to approximately 99% so that short light guides with high transmission are feasible. In addition, as a result of thermally insulating the waveguide on the outside, the primary infrared power that is absorbed will heat up the metal walls so that these in turn will emit secondary infrared radiation, a good part of which will be guided to the selected area(s).

At a dinner table the high temperature thermal storage can be disposed within a central pedestal underneath the tabletop, or within a soup-kettle type enclosure centrally located on the table. When the dinner table has a stone (e.g. granite or gabbro) top or a glass top, infrared radiation from the pedestal storage unit can be coupled into thermally insulated optical waveguides, can then be guided to selected areas underneath the plates or underneath the coffee cups, and upon absorption can heat up the stone or glass tabletop in these selected areas to the desired temperature.

When the dinner table has a wooden top, optical waveguides can be used to direct thermal radiation either in an approximately horizontal direction just above the tabletop or in an approximately vertical direction above the tabletop up and then back down for example through the use of curved mirrors.

For the approximately horizontal direction case, optical hollow-core metallic waveguides can run over the table from a centrally located soup-kettle-type lithic thermal storage unit and deliver thermal radiation to a metal plate with a 90-degree bend which absorbs it and in turn conducts the thermal energy to a dinner plate or coffee cup resting upon it. Alternatively, optical hollow-core waveguides can run underneath the table from a pedestal thermal storage and deliver thermal radiation to a U-shaped metal plate which is placed at the edge of the tabletop and which conducts the thermal energy from underneath the table to the tabletop area where a dinner plate or coffee cup is placed.

For the approximately vertical direction case, optical waveguides made up of curved mirrors can be used to project the thermal radiation from the thermal storage onto the dinner plate of the coffee cup on the dinner table.

When the need arises to keep people warm, secondary infrared radiation from at least some of the selected areas on the stone tabletop, or from some of the hot metal plates on a wooden table, can be used to keep people warm by letting infrared radiation propagate toward people either directly or with the help of suitably positioned mirrors. People can also be kept warm by using an approximately vertical direction of thermal radiation propagation to transmit primary thermal radiation directly onto people instead of onto food plates.

Thanks to good thermal insulators energy can be stored in a lithic storage medium for periods of one hour or more, which would be very useful for dining. With thermally insulated waveguides energy losses to the ambient can be minimized and the transfer of thermal energy to the selected area(s) can be maximized thanks to primary thermal radiation originating in the lithic thermal storage and to secondary infrared radiation originating in the walls of the waveguide(s).

The foregoing and other objects, advantages and features of the present invention will become more apparent upon reading of the following non-restrictive description of illustrative embodiments thereof, given by way of example only with reference to the accompanying drawings.

BRIEF DESCRIPTION OF THE DRAWINGS

Note: In the appended drawings the thermal radiation emitted by hot bodies is symbolized by "IR", which reflects the fact that the predominant part of the thermal radiation is infrared radiation for temperatures that are practical for a thermal storage unit.

In the appended drawings:

FIG. 1 is a cross sectional view of a "warming" table mounted on a central pedestal in which a lithic thermal storage unit is located, the "warming" table having a stone tabletop heated in selected areas by thermal radiation propagated from the pedestal by means of thermally insulated waveguides.

FIG. 2, which is also a cross sectional view, shows a warming table comprising a wooden tabletop, a lithic thermal storage unit in the central pedestal, waveguides similar to those in FIG. 1, and a metal plate to thermally conduct heat from underneath the table to selected areas on the tabletop.

FIG. 3 is a cross sectional view of a "soup kettle" type thermal storage unit which can be placed on the dinner table and which comprises a thermally insulated optical waveguide propagating thermal radiation to an optically absorbing metal plate that thermally conducts heat to underneath the food plate.

FIG. 4 is a cross sectional view of a warming table where a block of alumina is the medium for heat storage at very high temperatures and where curved mirrors constitute the means for optically guiding the thermal radiation in an approximately vertical direction up and then back down towards a food plate on the right, or towards a place on the left where a person might sit, wherein, in the thermal energy storage unit, heat is transported by thermal conduction from the alumina block to thermal radiation emitters.

FIG. 5 *a*) shows a thermal shutter of the table of FIG. 4 by means of a cross sectional view taken in a horizontal plane, as viewed from the top, wherein a flux of heat propagated from the alumina block to one of the thermal radiation emitters can be controlled through a sliding motion of an alumina disk forming part of the thermal shutter.

FIG. 5 *b*) shows the thermal shutter of the table of FIG. 4 in a cross sectional view taken in a vertical plane that cuts through the center of one of the thermal radiation emitters of FIG. 4, wherein the amount of surface overlap between the alumina disk and the thermal radiation emitter and hence the heat flux going to the thermal radiation emitter is controlled by sliding the alumina disk towards the left or towards the right.

FIG. 6 is a cross sectional view of a "soup kettle" type of thermal storage unit based on alumina wherein, as in the case of FIG. 4, curved mirror optical guides are used to direct thermal radiation toward the food on the right or at people (not shown) on the left.

FIG. 7 is a cross sectional view of a smaller wireless infrared heater about the size of a coffeepot wherein, as in the case of FIGS. 4 and 6, curved mirror optical waveguides direct the thermal radiation towards the coffee cup, or the food as the case may be.

FIG. 8 is a cross sectional view of a coffeepot type thermal radiation emitter which resembles that of FIG. 7 but is a little more compact.

FIG. 9 is a cross sectional view of a heater that is a variation of the heater of FIG. 7, the difference being that the thermal radiation emitter inside the first focussing mirror is a segment of optical waveguide into which infrared and visible radiation from the alumina block is optically coupled.

FIG. 10 is a cross sectional view of a soup kettle type thermal storage unit with an insulated waveguide resonator in the vertical position for keeping people warm at a dinner table.

FIG. 11 is a top view of a person sitting at a warming dinner table, in which gold flaps are shown whose low emissivity greatly reduces the emission of infrared radiation towards the sitting places adjacent to the occupied one.

FIG. 12 is a different version of the arrangement shown in FIG. 2, FIG. 12 showing one horizontal hot plate for cooking or warming food and one vertical hot plate for warming a person sitting at the dinner table.

FIG. 13 is a different version of the arrangement shown in FIG. 9, FIG. 13 showing a thermally insulated waveguide that has been extended up so that the thermal radiation emitter and a collimating mirror thereof direct infrared radiation in a downward direction.

FIG. 14 *a*) is a version of a lithic heater system for warming up people at a dinner table where a parabolic trough mirror is used to collimate the infrared emission from an infrared emitter, the latter being made in the form of a metal tubing placed along the mirror's line of focus. In FIG. 14 *b*) this emitter waveguide is fed from the end by a waveguide bringing infrared power from the thermal energy storage unit.

DETAILED DESCRIPTION OF THE ILLUSTRATIVE EMBODIMENTS

Blackbody Radiative Power

When a solid is heated to a high temperature it emits fluxes of thermal radiation which are intense enough for cooking. This can be seen every day on an electric stove covered by a transparent ceramic plate. The amount of red light emitted by a stove heating element is small, on the order of a few watts, but the infrared emission is high; it is on the order of one to three kilowatts, as required for cooking.

The solid emitters, as well as the cavities in solid blocks considered in the present specification, emit electromagnetic radiation, or "thermal radiation", that we will approximate with ideal blackbody radiation for illustration purposes. The formula giving the total radiated power P per unit area emitted by an ideal blackbody at temperature T is:

$$P=5.67\times10^{-8}T^4 \text{ Watts/m}^2 \quad (1)$$

Any given solid emitter and any given open cavity in a solid block will emit less than this theoretical maximum, but this formula will be used throughout to give the maximum radiated power per unit area that can be expected. In practice, the actual radiated power will be less than given by the ideal blackbody formula.

At 400° C. an open cavity will emit a total infrared power on the order of 11.6 kW/m$^2$ or 1.16 Watts/cm$^2$, while at 1000° C. the maximum power emitted in the form of thermal radiation will be 149 kW/m$^2$, or 14.9 Watts/cm$^2$. The approximately blackbody emission occurs over the full hemispherical solid angle of 2π steradians.

Solids at high temperatures can serve not only as emitters of infrared radiation but also as an energy storage medium in the form of sensible heat. For example, as mentioned in the foregoing description, gabbro rock has a specific heat of 0.8 kJ/kg and a density of 2.9. It can be heated to temperatures of approximately 900° C. without melting. In cooling from 900° C. to 400° C., one liter of gabbro will release about 1.16 MJ, i.e. 0.322 kWh of thermal energy. This energy can be released in the form of infrared radiation. A volume energy density of 322 Wh/L is approximately that of modern lithium-ion batteries. Rock therefore offers the potential of storing large amounts of energy at a much lower cost than lithium-ion batteries. This is especially true when the form of energy desired is directly available from rock, that being the case for infrared radiation.

In the present specification, gabbro rock and alumina will be used as non-limitative examples of materials capable of storing sensible heat at high temperatures. It must be understood, however, that these materials are used only for illustration and not as a restriction. One drawback of gabbro is that it can develop cracks under thermal cycling when the heating is not uniform. An example of other suitable materials would be olivine refractory bricks as discussed in U.S. Pat. No. 4,303,448 granted on Dec. 1$^{st}$, 1981 to R. L. Cochrane, B. M. Gay and H. I. Palmour for sensible heat storage applications at high temperatures. Different types of refractory concrete and ceramics are also materials that can be used. Since many man-made materials are derived from stone, the word "lithic" will be used in a general way to designate the thermal energy storage material, whatever it might be. Some metals and metal alloys, and some crystals, like sapphire or silicon, could also be conceivably used for high temperature thermal energy storage in some of the physically smaller applications that will be described below.

Guided Infrared from Solid Thermal Storage

In most applications the flow of energy needs to be controlled. In the case of thermal radiation from a lithic storage medium this can be achieved, for example, through the use of optical waveguides and adjustable shutters. One way of doing this is illustrated in FIGS. 1 and 2 which describe an application where the infrared radiation (IR) from a block of gabbro 2 is coupled into thermally insulated waveguides 101 and 102. Throughout the present specification a short arrow with the IR label will be used to designate infrared radiation as well as some visible radiation that accompanies it in a blackbody spectrum at temperatures above 600° C. Other forms of optical waveguides using curved mirrors for guiding thermal radiation are shown in FIGS. 4, 6, 7, 8 and 9. In the present specification and appended claims, the term "waveguide" should be construed in its broadest sense as an optical element or set of optical elements that guide infrared and visible electromagnetic radiation from a source of electromagnetic radiation to a selected or targeted area.

Warming and Cooking Table Application

FIG. 1 illustrates a "lithic warming and cooking table" where infrared emission from a gabbro stone block 2 is guided underneath a stone tabletop 4, by means of waveguides 101 and 102, to selected areas 41 and 42 underneath dinner plates 45 and 44, respectively. The gabbro block 2 and its thermal insulator 3 are located in the table's pedestal 30. Just under the selected area 41 under dinner plate 45 in FIG. 1, an infrared absorbing plate 1019 at the end of waveguide 101 absorbs the thermal radiation guided in from the gabbro storage, heats up and in turn transfers heat to the selected area 41 of the stone tabletop 4 which is in thermal contact with the absorber plate 1019. Only the selected areas in thermal contact with absorber plates such as 1019 heat up to a significant degree because lateral conduction of heat in the stone tabletop 4 is impeded by the poor thermal conductivity of stone (about 3 Watts/m-K) together with the relatively low temperature gradient in the lateral direction along the tabletop 4. In the vertical direction the heat flow from the absorber plate 1019 to the selected area 41 underneath dinner plate 45 is significant because the stone thickness is only about two centimeters and the surface area for thermal transfer is fairly large in the selected lithic area under a dinner plate. When shutter 6 is opened in FIG. 1 the same phenomena take place underneath dinner plate 44 as were explained above for dinner plate 45.

In order to avoid possible thermal expansion problems leading to cracking, the stone tabletop 4 can be cut, for example with a diamond saw blade, so that the selected areas 41 and 42 underneath the dinner plates 44 and 45 are circular pieces of stone. The small gap left by the saw blade would prevent thermal expansion of the heated selected areas from causing cracks in the stone tabletop. The circular pieces of stone could be supported by the absorber plates 1019 or by some other appropriate structural elements underneath the tabletop.

Waveguides 101 and 102 are thermally insulated by insulator 3, which also insulates the gabbro stone block 2 in the table's pedestal 30. Insulator 3 surrounding the gabbro is provided because of the very high temperatures involved. As far as thermal insulation for the waveguides 101 and 102 is concerned, although this thermal insulation is also labelled by the reference 3 for simplicity, thinner thermal insulation of a different type could be used since the temperature of the waveguides is much lower than that of the gabbro storage. In some cases where the waveguides are highly polished metal of low emissivity both on the inside and outside, the ambient air might be sufficient as a form of low-grade thermal insulation.

In infrared waveguide 101 an adjustable optical shutter 201 allows one to control the flux of thermal radiation toward the selected area 41 underneath plate 45. This optical shutter 201 can be mechanically constructed like a camera shutter with overlapping metal blades, preferably by using an infrared reflecting metal for the blades. Another level of control over the flux of thermal radiation is provided by thermal shutter 6 which is a block of thermal insulation and which can be slid at will over infrared emitting cavity 5. The thermal shutter 6 blocks infrared waveguide 102 in FIG. 1. In each waveguide both types of shutters could be used. Of course, an optical shutter 201 and a thermal shutter 6 could be placed in close proximity and be controlled jointly as one integrated unit.

Waveguides 101 and 102 in FIG. 1 can be hollow core metal waveguides. The inner surface of the metal is advantageously smooth. For higher infrared reflectivity one can electroplate or evaporate on the inner metallic surface a suitable metal coating. As an example, a gold coating on a very smooth surface can provide an infrared reflectivity of nearly 99% over broad spectral regions in the infrared (see the Epner Technology web site at http://www.epner.com/laser_properties.ssi#). Another example is an aluminum coating: it has a somewhat lower reflectivity but it can be very low-cost.

Referring to FIG. 1, a useful fraction of the infrared emission from cavity 5 in the hot gabbro block can be captured by hollow metal waveguides 101 and 102 and guided to the selected areas 41 and 42 to be heated underneath dinner plates 45 and 44. FIG. 1 illustrates the case where infrared emission is guided underneath the table to an infrared absorbing plate 1019 in thermal contact with the selected area 41 in the stone tabletop 4 underneath dinner plate 45. The guided infrared (IR) heats this selected area 41 of the stone tabletop to a temperature in the vicinity of 70° C. in order to keep food warm in a plate. For cooking one would need to let enough infrared be guided to heat the selected area to temperatures of 100° C. and more.

The waveguides 101 and 102 can be made of well-polished aluminum as an example. In the version of the warming table shown in FIG. 1 the waveguides 101 and 102 are thermally insulated by insulator 3. Since part of the infrared radiation propagating through the guide is absorbed by the metal walls, due to the metal's imperfect reflectivity, the walls heat up. Air convection from the lithic storage also heats up the walls. The heated walls in turn emit approximately blackbody radiation, which we will refer to as "secondary infrared", a good part of which is guided towards the selected area 41 on the right and towards the selected area 42 on the left when shutter 6 is open. The secondary infrared radiation provides additional power to heat up the selected areas 41 and 42. This heated waveguide secondary emission reduces in effect the infrared power loss of the waveguide. It is therefore advantageous to extend insulator 3 in FIGS. 1 and 2 in order to thermally insulate waveguides 101 and 102. The same principle applies to the structures shown in FIGS. 3, 10, 11, 12, and 13. Note that the thermal insulation specified in various locations in these drawings is to be understood as possibly being of a different nature according to the characteristics of the various parts.

The table shown in FIG. 1 as an example holds the lithic heat storage in a central pedestal 30. A system closely resembling that of FIG. 1 was tested experimentally. The sensible heat storage consisted of a gabbro stone having dimensions 20×20×23 cm with an array of nine vertically drilled holes (three rows of three), each 3.8 cm in diameter and drilled to a depth of 13 cm. Each hole was thus an approximation of cavity 5 in FIG. 1. The gabbro sample was heated to a temperature in the range 500-700° C. The total IR emitting surface provided by the 9 holes is 102 $cm^2$. At 500° C. the maximum emission power possible is about 200 watts and at 700° C. it is about 500 watts. The waveguides 101 and 102 used were made of chrome-coated stainless steel; they were held in position underneath a gabbro tabletop at an angle close to 45 degrees to the vertical. The cross sectional dimensions of the waveguides were approximately 15 cm×20 cm. At the selected areas 41 and 42 a temperature in the range 70-80° C. was maintained for about two hours. When only one waveguide was opened and the other one closed with an insulator block 6, a steak could be cooked on the selected and heated area in about ten minutes.

Coming back to FIG. 1, each waveguide 101, 102 is provided with a reflective IR shutter such as 201 that can be adjusted to let a desired power level of IR reach the selected area and to reflect the rest back into the waveguide towards the heat storage medium. This way some of the energy radiated into the waveguide is returned to the storage medium to keep it hot longer.

To heat up the lithic thermal storage, electrical resistive heating wires 222 can be placed in various places in the gabbro block in order to assure uniform heating and minimize cracking due to thermal stresses. Other methods of heating, such as the use of microwave heating, could also be used in practice.

Heating Table Logistics

When operating this heating table in a café-terrace for example, the restaurant employees would connect the electric power to the resistive elements in the morning before the clients come in. Another possibility would be for heating at night using the then cheaper network electricity. Once the thermal storage units are at the desired high temperature, they would be placed in the pedestals of the tables and operate wireless through the lunch period and possibly through the dinner period. It would not be practical in a restaurant and even in many homes to have electric wires run over the floor and potentially cause people to trip over them. So the wireless feature provided by the lithic storage is desirable.

Use of Additional Metallic Heat Conductors.

FIG. 2 shows another version of the IR heating table which is adapted to a wooden tabletop 40. Here U-shaped metal plates 47 are used to thermally conduct heat from the absorber plate 1019 to the dinner plates 44 and 45 by taking the flux of thermal radiation around the tabletop's edge. The metal plates 47 could be made of copper or aluminum, which are very good heat conductors (390 watts/m-K for copper, 237 watts/m-K for aluminum), with a thickness between 5 and 10 millimeters underneath the dinner plate 44 or 45, and between 10 and 20 millimeters around the edge and under the tabletop. In the direction perpendicular to the plane of FIG. 2 the width of the metal plates could be in the range 10 cm (for a coffee cup) to 20 cm (for a dinner plate). Since the average distance that the thermal radiation has to travel around the U-shaped bend in the metal is on the order of 25 cm, a modest temperature gradient on the order of one or two degrees Celsius per centimeter is enough to drive an adequate heat flux (or thermal radiation flux) from the absorber plate to the dinner plate. A one- or two-millimeter thick layer of thermal insulator 303 over part of the metal plates would prevent people from burning themselves. The remarks made above concerning the thermal shutter 6 and the optical shutter 201 also apply here.

"Soup Kettle" Guided Infrared Heaters.

The version of the guided infrared heater shown in FIG. 3 can take the shape of a "soup kettle" type enclosure 333 and be positioned on a tabletop 4 for example in its central area. A thermally insulated waveguide 1013 feeds thermal radiation into a right-angle-shaped metal plate 477 whose suitably treated surface absorbs it. The thermal energy in the form of heat is then thermally conducted by the metal plate 477 to underneath dinner plate 45 and heats it. As mentioned earlier, the thermal insulation 3 over the waveguide 1013 could be of a nature different from that around the gabbro block. As earlier, the flux of infrared thermal radiation can be controlled by an insulator block 6201 which can be slid across the waveguide 1013 near the exit end of cavity 5 in the gabbro block 2. This insulated block shutter 6201 could be made of a piece of thermal insulation covered by plates of infrared reflecting metal, thus combining the characteristics of thermal shutter 6 and optical shutter 201 described earlier.

Note that cavity 5 and waveguide 1013 could have a round or a rectangular cross section as seen in a vertical plane perpendicular to the direction of propagation of the infrared flux in FIG. 3. The advantage of the rectangular cross section is that it is better adapted to the dimensions of a dinner plate and that it can permit larger infrared powers to be transmitted because of the larger cross section possible. A round cross section could be aesthetically pleasing and would be adapted to keeping a coffee cup hot.

Curved Mirror Waveguides and Metal Infrared Emitters

Infrared waves (thermal radiation) can also be guided by curved mirrors as illustrated in FIGS. 4, 6, 7, 8, 9, 13 and 14. Whereas the cavity emitter geometry of FIGS. 1-3 gives a highly divergent pattern of infrared thermal radiation, the curved mirror optical wave guiding means of FIGS. 4, 6, 7, 8, 9 and 13 give a more collimated beam of infrared thermal radiation suitable for heating selected areas with thermal radiation coming from above the dinner table. An alumina thermal storage medium 21 is chosen in this example. Alumina has a thermal conductivity of about 5 Watts/meter-Kelvin at 1000° C. In FIGS. 4-8, thermal radiation is propagated to the infrared, thermal radiation emitter 552 by the mechanism of solid thermal conductivity in a thin alumina disk 551 shown in more detail in FIGS. 5 *a*) and *b*). The alumina disk 551 need be only a few millimeters thick so that its thermal resistance is low.

When the alumina disk 551 fully overlaps the emitter 552 in FIGS. 4-8, there being a physical contact and hence a good thermal coupling between the surfaces of the disk and the emitter, the thermal shutter 5510 is open and a large flux of thermal radiation propagates through the emitter 552 through the mechanism of solid thermal conductivity. Note that in FIGS. 4-8 and 13, for the sake of clarity, the air gaps between the alumina disk 551 and the adjacent parts are shown larger than it would be in reality. When the alumina disk 551 only partially overlaps the emitter 552, as in the example shown in FIGS. 5 *a*) and *b*), the flow of heat (thermal radiation) is reduced in accordance with the amount of overlap. The amount of overlap, and hence the flux of thermal energy, is varied by sliding thermal shutter 5510 sideways as shown in FIG. 5 *b*). "Sideways" in FIG. 5 is in the direction indicated by the double-headed arrow 30030, that direction being perpendicular to the plane of FIG. 4. In FIGS. 4-8 the thermal shutter 5510 comprises thermal insulator 3003 and alumina disk 551 which is imbedded in it. When the thermal shutter 5510 is in the "off" position the small rectangle pointed by the label "thermal shutter 5510" in FIGS. 4-8, denotes the place occupied by a part of insulator 3003. The flow of heat through the alumina disk 551 is then blocked by thermal insulator 300 which is adjacent to emitter 552 in FIGS. 4, and 6-8.

When the alumina disk 551 is slid over completely to the side, so that no overlap with emitter 552 takes place, the thermal shutter is off because the thermal radiation propagation path for heat transport is almost completely closed by thermal insulator 3003 shown in FIGS. 5 *a*) and *b*).

The operating principle of thermal shutter 5510 is not restricted to the circular cross sections presented by alumina disk 551 and emitter 552 in FIG. 5. These cross sections could be rectangular and the same adjustable overlap principle would apply. Also note that in certain applications, rectangular cross sections for the infrared radiation transport and emission components could also be more useful together with parabolic trough geometries for the collimating optics. In FIG. 7, for example, mirrors 56 and 57 could be parabolic trough reflecting mirrors, i.e. cylindrical mirrors reflecting a beam of thermal radiation with a rectangular cross section, the long side of this rectangular cross section being in a direction perpendicular to the plane of FIG. 7.

Thermal radiation emitter 552 is best made of a metal alloy exhibiting high resistance to oxidation at high temperatures and good thermal conductivity. One such alloy is HAYNES 214 alloy made up of nickel, chromium, aluminum, iron and a few other elements in small proportions (see web site www.haynesintl.com/214H3008C/ for the characteristics of this alloy). This alloy can be used up to temperatures of 1200° C., at which temperature its thermal conductivity is 36 watts/ m-K. For a thermal radiation emitter of 2-cm radius and 5-cm length, a temperature drop of 200° K over a 5-cm length will give a thermal power flux of about 160 watts, which is adequate. Note that the alumina disk 551 could be replaced by a disk made of a high-temperature alloy such as HAYNES 214 in order to minimize the temperature drop through the disk.

In FIGS. 4 and 6, the thermal radiation 8 and 88 from emitters 552 is collimated by means of curved mirrors 56 and 568 onto curved mirrors 57 and 578, respectively. Mirror 57 has a curvature such that the infrared radiation 9 is refocused into a dinner plate 45, thus warming it up. Mirror 578 has a smaller curvature so that the radiation 98 is broadly aimed at a person sitting at the table in order to warm her/him up. As in FIG. 1 resistive heating wires 222 may be used to heat the alumina prior to the table's period of use. Optical shutters 201 and 202 provide an added level of control over the intensity of thermal radiation delivered to the selected areas. The collimating curved mirrors 56, 568 and 569 may have a nearly parabolic profile with their focal plane at the cylindrical radiating part of emitters 552, i.e the part not covered by the cap 5522 or by the thermal insulation 300. For greater efficiency of the collimating mirrors their extent in the direction of propagation of light could be more than shown in FIGS. 4, 6-9, 13 and 14, just as one does in certain types of automobile headlights.

The function of the cap 5522 in FIGS. 4, 6, 7, 9, 13 and 14 is to minimize the amount of infrared emitted in a direction where the IR does not hit the collimating curved mirrors 56, 568 and 569. This is also done in automobile headlights in order to obtain a well collimated beam of light. The cap 5522 here would be a disk of thermal insulation covered by a layer of low emissivity metal. This would minimize infrared emission from the cap.

In FIG. 4 the function of the thermal insulation 300 is to minimize the emission of thermal radiation from a part of the emitter which is a bit removed from the focal plane of the curved collimating mirrors 56 and 568. Thanks to this insulation 300 and to the insulating cap 5522 a large fraction of the infrared and visible light is emitted towards the collimating mirrors and there results fairly well collimated beams 8 and 88 in FIG. 4. The same remarks regarding the insulating caps and the thermal insulation over parts of the thermal radiation emitters apply to similar components in FIGS. 6, 7, 9 and 13.

In FIGS. 4 and 6 a heat sinking stone 2324 (seen as three slender rectangles in the cross sectional view of FIG. 4 supporting infrared window 77) is thermally coupled to mirrors 56 and 568 which heat up as a result of being imperfect reflectors and as a result of thermal leakage through thermal insulator 300. Infrared window 77 is mounted on the heat sink stone 2324 and is cooled by virtue of its thermal coupling with the stone. Thanks to that window 77 a noble gas could fill the volume bounded by the window, by the emitters 552 and by the curved mirrors 56 and 568 to prevent oxidation of the emitters 552. This would permit the use of metal alloys with a larger thermal conductivity and higher temperature capability, and therefore permit more infrared and visible light power to be emitted.

Warming and Cooking Guided Thermal Radiation Devices on the Tabletop

The cross sectional view of FIG. 6 shows the "soup-kettle" type of alumina-based guided thermal radiation heater with components similar to those of FIG. 4, the difference being the location on the dinner table as opposed to underneath the table as illustrated in FIG. 4. By means of curved mirrors 56 and 568 broad infrared beams 8 and 88 are collimated onto curved mirrors 57 and 578, respectively, which in turn broadly focus the infrared beams 9 and 98 into the desired directions. Beam 9 is broadly focused onto dinner plate 45. Thermal shutter 5510 controls the flux of thermal energy delivered to the emitters, and shutters 201 and 202 control the fraction of the emitted infrared thermal radiation supplied to the selected areas. Given effective thermal shutters 5510, the optical shutters 201 and 202 may not be required. The other components of FIG. 6 function as explained in the foregoing description in relation to other figures. Note that this version of the lithic thermal radiation heater can be used as a stand alone unit on the floor of a restaurant terrace or on the floor of a house or patio, either to keep food warm on a table or to keep people warm around a dinner table. In this case the mirrors 57 and 578 would be held higher than shown in FIG. 6 relative to the base of the alumina block.

Compact "Coffee-Pot" Version of the Guided Infrared Heater

FIG. 7 shows a cross sectional view of a smaller version of a "coffeepot" type guided infrared heater based on high temperature storage in a block of alumina 21. As in FIGS. 4 and 5, the flux of thermal energy supplied to the thermal radiation emitter 552 is controlled by thermal shutter 5510. The thermal radiation emitted by the emitter 552 is collimated by curved mirror 56 into beam 8 and directed onto curved mirror 57 which in turn focuses the thermal radiation beam 9 onto a coffee cup 444 placed on tabletop 4. Again, a heat stone sink 232 is thermally coupled to collimating mirror 56 and to infrared window 77 in order to prevent overheating of the same.

FIG. 7 shows no resistive heating wires, although the same could be used. The absence of wires is to underline the fact that the compact device could be heated up in a microwave oven. For this operation one would remove the top half of the heater which includes the metallic thermal radiation emitter 552 and the metallic mirror 56. In order to be efficiently heated by microwaves, a storage material other than pure alumina might be more useful. For example, a grade of alumina containing impurities to increase loss tangent would facilitate microwave heating. Gabbro rock has a microwave loss tangent which makes it easy to warm up in a microwave oven; this has been observed experimentally in laboratory. Gabbro could therefore be used in the heater of FIG. 7 for thermal storage.

FIG. 8 shows a variation of the "coffeepot" version shown in FIG. 7, whereby a single curved mirror 569 is used to project thermal radiation onto a coffee cup or a dish. The heat sinking stone 232 serves to cool the collimating mirror 569 and to support the block 21, made for example of alumina, used for thermal storage. The other numbered elements are the same as those illustrated in FIG. 7 and, therefore, will not be further described in the present specification. Of course, any secondary infrared radiation emitted by the heat sink stone 232 will contribute to warm up the coffee cup 444, or a food plate, as the case may be.

FIG. 9 illustrates a variation of the heat transfer from the heat storage block 21, for example made of alumina, to the emitter 5521. In FIG. 9, thermal radiation is transmitted by the waveguide formed by cavity 5, short refractory metal alloy tubing segments 5512 and 5514 and a refractory metal alloy tubing 5521 playing the role of the infrared emitter. This last waveguide and infrared emitter 5521 is capped by a disk 5522 which could be chosen, for example, to be a thermally insulating disk coated with a low emissivity metal on its outer surface. This way most of the emitted thermal radiation would come from the external cylindrical surface of metal alloy tubing waveguide 5521 and would be collimated by curved mirror 56 into infrared beam 8 with high optical efficiency. The advantage of using hollow metal tubing in the emitter waveguide 5521, in waveguide 5514, and in the part called "waveguide shutter 5512" in FIG. 9 is that at very high temperatures, i.e. at 900° C. and above, more power can be transported via radiation than via thermal conduction for the distances of interest. For optimum performance of the refractory metal tubing waveguide 5521 as an infrared emitter, one would texture or coat its inside surface so that it absorbs a large fraction of the thermal radiation impinging thereon after its transmission through waveguide section 5514. This way most of the infrared thermal radiation propagated through the waveguide 5514 will be absorbed in waveguide emitter 5521, which in turn will re-emit a large amount of infrared thermal radiation onto the collimating mirror 56. In certain applications, such as the one shown in FIG. 13, one may also find it useful to extend waveguide 5514 to greater lengths for the efficient transport of infrared power from the alumina block to the emitter 5521 of secondary infrared. The outside surface of infrared emitter waveguide 5521 would also be textured or coated in order to optimize its emissivity.

The operating principle of the waveguide shutter 5512 is the same as for the thermal shutter 5510 shown in detail in FIG. 5, i.e. for a perfect overlap condition shown in FIG. 9, a maximum flux of thermal radiation is transmitted to waveguide 5514 and then to the emitter 5521, whereas for partial overlap, less thermal radiation is transmitted. In a condition of no-overlap, thermal insulation 3003 (see FIG. 5) is in the way, and almost no thermal radiation is supplied to waveguide 5514 and to the emitter, so that the waveguide shutter is off. Also, at very high temperatures, i.e. 900° C. and above, some fraction of the blackbody emission is visible and can be seen as red or orange light. This combination of infrared and visible emission in beams 8 and 9 of FIG. 9 could be useful in some niche applications.

People-Warming Use of the Warming IR Table

People frequently desire a little more heat on themselves to be comfortable. In both versions of the table one could have IR outputs designed for people-warming. For the FIG. 1 version, extra adjacent areas on the table can be warmed up by thermal radiation propagated by optical waveguides. Vertical mirrors placed on the table can reflect the secondary IR emitted by the areas adjacent to the person dining at the table onto him/her, as desired. Each person could adjust these mirrors as pleases her/him. Another way is described in FIGS. 10 and 11 where waveguide resonators 1020 are used to warm up people. The waveguide resonator 1020 is a cavity where all walls, which can be made of smooth millimeter-thin metal, as an example, reflect the thermal radiation so that infrared and visible light rays bounce around a few times before being absorbed completely. As radiation is absorbed, the metal walls heat up and emit secondary infrared radiation which can be used to warm up people. A thin layer of infrared-transparent insulation 344 would surround the waveguide resonator 1020 so that people would not burn themselves. As described earlier, a shutter 2019 can be used to control the infrared power level going from the "soup kettle" enclosure (see FIG. 10) into the waveguide cavity resonator 1020. As described earlier, an optical shutter 201 controls the level of infrared destined to warm up dinner plate 45 placed on tabletop 4.

FIG. 11 shows an arrangement whereby a person is warmed by two such heaters. Gold flaps 10204 and 10205 are used to avoid warming up a neighbour, if so desired. The other numbered elements play the same roles as in FIG. 10.

Warming Up Food and People

FIG. 12 *a*) illustrates in cross section a table with tabletop 40 where waveguide 101 on the right hand side is used to heat up a metal plate 477, which is U-shaped as in FIG. 2, and which couples a heat or thermal energy flux into a vertical metal plate 4712. This vertical plate heats up and emits secondary infrared radiation which traverses a thin layer of infrared transparent thermal insulation 344 and impinges on a person to warm him/her up. This is similar to what is shown in FIG. 11, except that in FIG. 12 the infrared comes from the pedestal underneath the table, thus liberating space on the tabletop. Power to the metal plate radiant heater 4712 could be reduced or cut off by controlling the flux of primary thermal radiation from the pedestal thermal storage unit by means of optical shutter 101 or by means of a thermal shutter 6, or by means of both.

FIG. 12 *b*) shows an end view of the radiant heater plate 4712 and metal plate 477, as seen form the right hand side of FIG. 12 *a*). Plate 4712 could be made of copper or aluminum, both of which are excellent heat conductors. The surfaces of plate 4712 would have been textured or chemically treated in order to increase their infrared emissivity. The radiant heating plate 4712 needs to be only about one centimeter thick, but the metal plate 477 is made about 10 centimeters wide in order to conduct a good flux of heat or thermal radiation under a small temperature difference between its part below the tabletop and that above the tabletop. The IR transparent insulator 344 can be only about one millimeter thick or so in order to prevent people from accidentally burning their hands. A temperature in the range 75-120° C. for radiant heater plate 4712 would be sufficient in most cases for warming up people.

Targeted Space Heating

FIG. 13 is a cross sectional view illustrating another arrangement whereby a person sitting on a chair 446 at a dinner table 445 could be warmed up by an "infrared lamp" fed by a thermally insulated waveguide reaching down to the high temperature alumina block thermal storage unit. Note that for the sake of clarity FIG. 13 shows the lithic storage and waveguide system as fairly large in proportion to the chair and table, but in practice this system could me made much more slender and compact. The same remark also applies to the preceding figures regarding the apparently large sizes of the thermal storage units and the thermally insulated waveguides; in practice they would be somewhat more compact than shown in the preceding figures.

FIG. 13 is a variation of the arrangement shown in FIG. 9, whereby infrared thermal radiation (IR) from an alumina storage block 21 is propagated through a thermally insulated waveguide 5514 to the secondary thermal radiation emitter 5521 in order to send a broad beam of infrared thermal radiation 9 over table 445 and chair 446 by means of reflection off collimating mirror 56. In FIG. 13 waveguide 5514 can be made of a refractory metal alloy so that in can support very high temperatures, if need be. Heat losses to the outside are minimized by the thermal insulation 300 surrounding waveguide 5514 and by covering this insulation with a low emissivity metal enclosure 23214 which also serves as a heat sink for mirror 56 collimating the emitted infrared and visible beam 9. As in FIG. 9 a window 77 seals the emitter 5521 and the collimating mirror 56, thus forming a lamp. Window 77 could be made of sapphire as an example. If only invisible infrared radiation is desired, window 77 could be formed, for example, of a crystalline substrate of purified silicon. These remarks on window 77 apply to FIGS. 4 and 6-9 as well. As in FIG. 9 a waveguide shutter 5512 can be used to control the power level of infrared thermal radiation beam 9. The other components bearing the same reference numerals as in FIG. 9 play the same role as in FIG. 9.

The cross sectional view shown in FIG. 13 can be one of a three-dimensional geometry where cavity 5 in the alumina block 21 is a circular hole, where waveguide 5514 is a circular metal pipe bent towards emitter 5521, said emitter being ring-shaped, and where mirror 56 is a section of paraboloid; or the cross sectional view can be one of a three-dimensional geometry where cavity 5 is a deep rectangular slot extending deeply into the plane of FIG. 13, where waveguide 5514 has a rectangular cross section with its longest dimension into the plane of FIG. 13, where infrared emitter 5521 has a similarly rectangular cross section with its longest dimension into the plane of the figure, and where mirror 56 is a parabolic trough whose longest dimension is again into the plane of FIG. 13. The advantage of the rectangular cross sectional geometry is that larger fluxes of infrared thermal radiation can be propagated and then radiated out.

Targeted Space Heating

Various versions of the above described heaters can be adapted to targeted people-warming in a house. In this case the optics are chosen to spread IR all over the person, not just the upper part of the body as on the table. Note that in the table version, the pedestal metal enclosure could have an array, or arrays of adjustable holes, to let some IR warm up people's legs to the desired level. The structures shown in FIGS. 13 and 14 could replace the burners that are used to warm up people on the terraces of certain restaurants. These lithic infrared heaters would be safe and silent, a significant advantage over propane burners, which are noisy, smelly and prone to accidents. In FIGS. 13 and 14 a waveguide 5514 of larger cross section could be used to feed power to several emitters 5521 pointed in different directions so that several infrared beams 9 would be available to warm up several tables at the same time. As in FIG. 9 a waveguide segment type thermal shutter 5512 (analogous to thermal shutter 5510 in FIG. 5) could be installed in the thermal radiation propagation path between waveguide 5514 and each individual emitter 5521 so that each person, or persons at each table 445, could individually adjust the power in each individual infrared beam 9 to a desired level.

Waveguide Emitter in a Parabolic Trough Mirror

FIG. 14 *a*) illustrates an arrangement similar to that of FIG. 13 except that the infrared waveguide emitter 5521 is now placed so that its axis of cylindrical symmetry points perpendicular to the plane of FIG. 14 *a*). In this case the cross sectional view of FIG. 14 *a*) represents a three-dimensional geometry where cavity 5 is a deep rectangular slot extending deeply perpendicular to the plane of FIG. 14 *a*), where waveguide 5514 has a rectangular cross section with its longest dimension perpendicular to the plane of FIG. 14 *a*), where infrared emitter 5521 has a similarly rectangular cross section with its longest dimension parallel to the plane FIG. 14 *a*), and where mirror 56 is a parabolic trough whose longest dimension is again perpendicular to the plane of FIG. 14 *a*). The advantage of the rectangular cross sectional geometry is that larger fluxes of infrared thermal radiation can be transported to the outside wall of waveguide emitter 5521. The latter can be textured or treated to be highly absorbing so that it heats up to a high temperature, thus emitting a large infrared secondary power into collimating mirror 56.

FIG. 14 *b*) is a variation of FIG. 13 and FIG. 14 *a*). Here the waveguide 5514 has a simple circular pipe geometry and it feeds infrared thermal radiation into the end of metal tubing-type waveguide emitter 5521 whose long dimension in perpendicular to the plane of FIG. 14 *b*), and whose position is at the focus of the parabolic trough mirror 56 of FIG. 14 *a*). An infrared reflector 55211 is placed at the end of emitter waveguide 5521. For this hybrid geometry, waveguide emitter 5521 could be made as a metal pipe that is coated for high reflectivity on its internal surface and for good emissivity on its external surface. The large emitting surface of waveguide emitter 5521 in this geometry would permit large infrared powers to be emitted.

Although the present invention has been described hereinabove by way of non-restrictive illustrative embodiments thereof, these embodiments can be modified at will, within the scope of the appended claims without departing from the scope and spirit of the present invention.

What is claimed is:

1. A system for supplying thermal energy to a selected area, comprising:

a sensible heat storage;

a thermal radiation emitter supplied with thermal energy from the sensible heat storage;

an optically guiding arrangement supplied with thermal radiation from the thermal radiation emitter and defining a thermal radiation propagation path from the thermal radiation emitter to the selected area; and an adjustable control of a flux of thermal radiation through the propagation path to control an amount of thermal energy supplied to the selected area, the adjustable control comprising a thermal shutter between the sensible heat storage and the thermal radiation emitter.

2. A system as in claim 1, wherein the adjustable control comprises at least one adjustable shutter in the optically guiding means to vary an effective cross-sectional area of the optically guiding arrangement means over which thermal radiation is propagated.

3. A system as in claim 1, wherein the optically guiding arrangement comprises at least one curved mirror.

4. A system as in claim 1, wherein the thermal shutter comprises a piece of thermally conducting material and a mechanism for moving the piece of thermally conducting material between the sensible heat storage and the thermal radiation emitter.

5. A method for supplying thermal energy to a selected area, comprising:

storing thermal energy in a sensible heat storage;

generating thermal radiation from the thermal energy stored in the sensible heat storage;

optically guiding the thermal radiation through a thermal radiation propagation path toward the selected area; and controlling a flux of thermal radiation through the propagation path to control an amount of thermal energy supplied to the selected area, wherein controlling the flux of thermal radiation comprises thermal shuttering the thermal energy from the sensible heat storage.

* * * * *